United States Patent [19]

Nakamura

[11] 4,385,475

[45] May 31, 1983

[54] COMBINATION OF HOLLOW MEMBER AND BACKING MEMBER

[75] Inventor: Kenichi Nakamura, Nyuzenmachi, Japan

[73] Assignee: Yoshida Kogyo K. K., Tokyo, Japan

[21] Appl. No.: 202,350

[22] Filed: Oct. 30, 1980

[30] Foreign Application Priority Data

Nov. 22, 1979 [JP] Japan ..... 54-162197[U]

[51] Int. Cl.[3] ..... E04B 1/38

[52] U.S. Cl. ..... 52/709; 52/721; 52/731; 49/399

[58] Field of Search ..... 52/787, 721, 731, 712, 52/709, 710; 49/399, 400, 504; 411/84, 85, 90, 411/92

[56] References Cited

U.S. PATENT DOCUMENTS

| | | | |
|---|---|---|---|
| 2,249,923 | 7/1941 | Whitcombe | 411/85 |
| 2,429,833 | 10/1947 | Luce | 411/84 |
| 2,762,398 | 9/1956 | Adam | 52/710 X |
| 2,767,609 | 10/1956 | Cousino | 52/709 X |
| 3,458,955 | 8/1969 | Brooks | 49/399 X |
| 3,774,345 | 11/1973 | Cole et al. | 49/504 |
| 4,263,952 | 4/1981 | Kowalski | 52/710 X |

*Primary Examiner*—Price C. Faw, Jr.
*Assistant Examiner*—Carl D. Friedman
*Attorney, Agent, or Firm*—Hill, Van Santen, Steadman, Chiara & Simpson

[57] ABSTRACT

Disclosed herein is an improved combination of a hollow member and a backing member to be inserted therein. Another member such as a hinge is secured to the hollow member by machine screws which extend through the hinge and the wall of the hollow member and are tightened in threaded holes in the backing member. The hollow member is provided with an inwardly extending pawl and the backing member is adapted to be placed in a desired position in the hollow member by engagement with the pawl. When a plurality of backing members are to be placed in the hollow member, a plurality of pawls are formed in the hollow member so that they are laterally offset from each other with respect to the longitudinal direction of the hollow member and a void portion is formed in each backing member so that the pawls above the intended pawl do not interfere with the backing member as it is inserted in the hollow member.

3 Claims, 10 Drawing Figures

Fig. 8
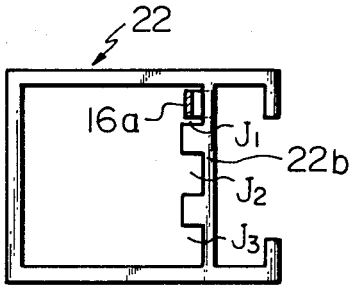
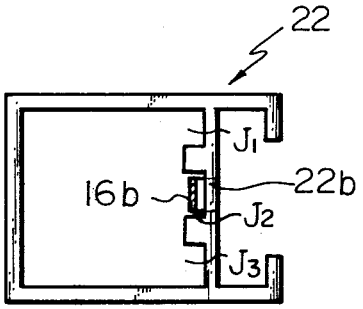
Fig. 9
Fig. 10
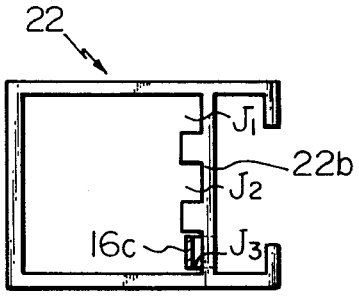

COMBINATION OF HOLLOW MEMBER AND BACKING MEMBER

BACKGROUND OF THE INVENTION

This invention relates to a combination of a hollow member and a backing member which is inserted in the hollow member to function as a nut upon securement of another member to the hollow member as well as to reinforce the portion of the hollow member where such other member is secured. More specifically, this invention relates to a combination of a hollow member and a backing member in which the backing member may be accurately positioned in the hollow member without necessity of access to the interior of the hollow member.

When it is necessary to mount some members, such as hinges, to hollow members of various shapes by machine screws, such steps have been employed as inserting in a hollow member a flat backing member having female screw thread holes and functioning as nuts and passing screws from the side of a hinge so as to tighten it against the backing plate. When it is impossible to give access to the interior of a hollow member due to its shape and size, a mounting jig having a recess for accommodating a backing plate is used for conveying the backing plate from the outside of the hollow member to the place in the hollow member where the backing plate aligns with holes formed in the hollow member for passing screws. After this operation, the screws are tightened against the backing plate for supporting the same. This assembling operation is very burdensome and time consuming.

Japanese Utility Model Publication No. 25567/1979 shows an idea which improves the abovementioned assembling operation. According to this Publication, one end of a backing member, which is to be inserted in a hollow member and has female screw thread holes, is extended to an open end of the hollow member where a registration shoulder is formed. By engagement between this shoulder and the edge of the open end of the hollow member, the backing plate is placed in a desired position. However, with this technique, various kinds of backing plates are necessary according to the distance between the edge of an open end of a hollow member and screw passage holes in the hollow member. This is a drawback in the light of management of parts and production cost. Furthermore, it is impossible to use a plurality of backing plates in one hollow member. This is another drawback since the application of the technique should be limited.

SUMMARY OF THE INVENTION

An object of this invention is to provide a combination of a hollow member and a backing member in which the backing member may be easily positioned in the hollow member and of which the production cost is low.

Another object of the invention is to provide a combination of a hollow member and backing members in which a plurality of backing members may be placed in desired positions in the hollow member.

According to this invention, a hollow member is provided with an inwardly projecting pawl. The pawl is so placed that it stops a backing member in a predetermined desired position when the backing member is inserted from an open end of the hollow member. Such arrangement as above may be obtained at low cost and permits easy positioning of the backing member. When a plurality of backing members are to be positioned in a hollow member, a plurality of pawls inwardly projecting of the hollow member are provided at different positions so that the backing members are placed in respective desired positions by engagement with the pawls. The pawls are laterally offset from each other with respect to the longitudinal direction of the hollow member and the backing members, at least ones except for the one closest to the end of the hollow member through which the backing members are inserted, are provided with void portions so that they do not interfere with the pawls above the intended one as they are inserted from the end of the hollow member. Due to such arrangement as mentioned above, a plurality of backing members may be easily positioned in one hollow member. Furthermore, since the backing members may be substantially identical in shape, cost for production may be kept low.

These and other objects and features of the invention will be apparent from the following description of embodiments of the invention referring to the accompanying drawings.

BRIEF DESCRIPTION OF THE DRAWINGS

FIGS. 8 to 10 are cross sectional view of the frame member shown in FIG. 6 showing pawls in lower, middle and upper positions of the side frame members, respectively.

DETAILED DESCRIPTION OF THE PREFERRED EMBODIMENT

Figure 1:
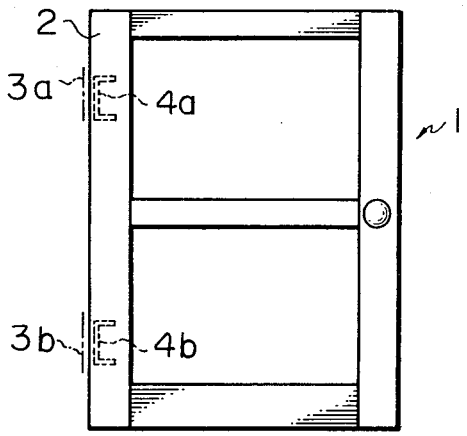
FIG. 1 is an elevational view of a door in which one embodiment of this invention is used in a side frame member of the door on which hinges are to be mounted.
Figure 3:
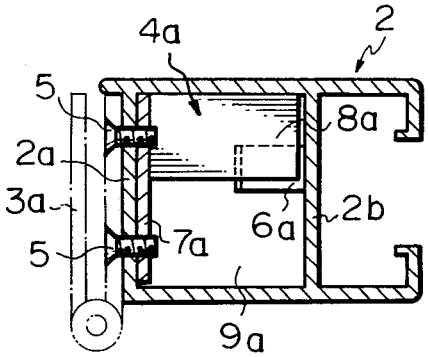
FIG. 3 is a sectional view of the frame member taken along line III—III in FIG. 2.
Figure 4:
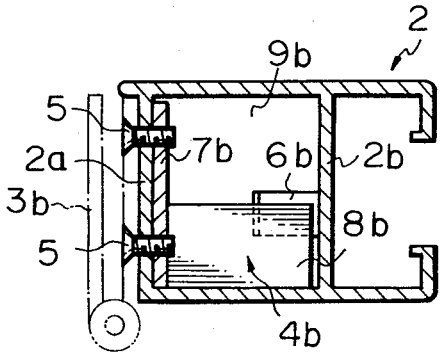
FIG. 4 is a sectional view of the frame member taken along line IV—IV in FIG. 2.
Figure 2:
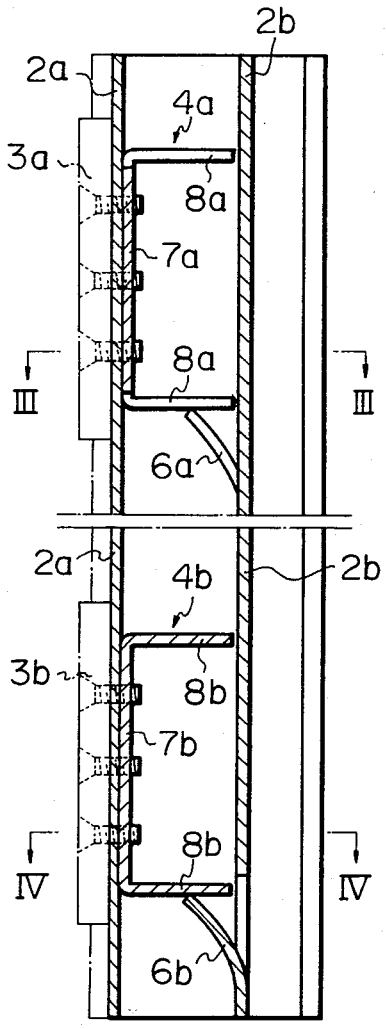
FIG. 2 is a longitudinal sectional view of the frame member shown in FIG. 1.

FIG. 1 shows an embodiment in which two backing members, namely an upper backing member **4*a* and a lower backing member 4*b* are placed in a frame member 2 which has a hollow portion and is provided at one side of a door 1. Hinges 3*a* and 3*b* are to be fixed to the frame member. Detailed description of this embodiment will be made referring to FIGS. 2 to 5. As is shown in FIG. 2 which is a longitudinal section of the frame member 2 in FIG. 1, the forward end plate 2*a* is provided with holes for passing machine screws at the places where hinges 3*a* and 3*b* are to be mounted. In the rear end plate 2*b* connecting the side plates of the frame member 2 and forming in cooperation with the forward end plate 2*a* a hollow portion, pawls 6*a* and 6*b* are provided which inwardly project in the hollow portion at the places opposite to the holes in the forward end plate 2*a*. The pawls 6*a* and 6*b* are laterally offset from each other with respect to the longitudinal direction of the hollow member or frame member 2. As shown in FIGS. 3 and 4, the pawls are disposed in upper and lower positions, respectively (as seen in these drawings), with respect to the center of the hollow member 2**.

Each of backing members 4a and 4b comprises a backing plate portion 7a or 7b having female screw thread holes and leg portions 8a or 8b bent from the opposite ends of the backing plate portion 7a or 7b so that they extend substantially normal to the backing plate portion. The leg portions 8a and 8b function to keep the backing plate portions 7a and 7b adjacent and parallel to the forward end plate 2a. The leg portions 8a and 8b are provided with void portions 9a and 9b, respectively, leaving portions to be engaged by the pawls 6a and 6b.

As is shown in FIG. 3, the upper backing member 4a has the void portion 9a in the lower portion (as seen in the same drawing) of each leg portion 8a and the pawl 6a is formed on the rear end plate 2b of the frame member 2 at the place upwardly displaced from the center of the rear end plate. As is shown in FIG. 4, the lower backing member 4b has the void portion 9b in the upper portion (as seen in the same drawing) of each leg portion 8b and the pawl 6b is formed on the rear end plate 2b of the frame member 2 at the place downwardly displaced from the center of the rear end plate.

Figure 5:
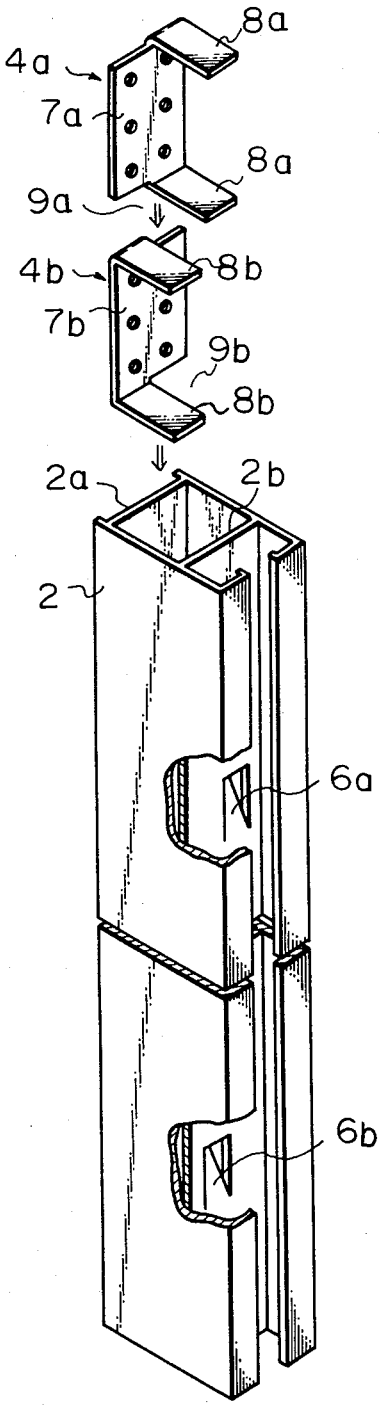
FIG. 5 is an exploded perspective view of the frame member and backing members to be inserted in the side frame member.
Figure 6:
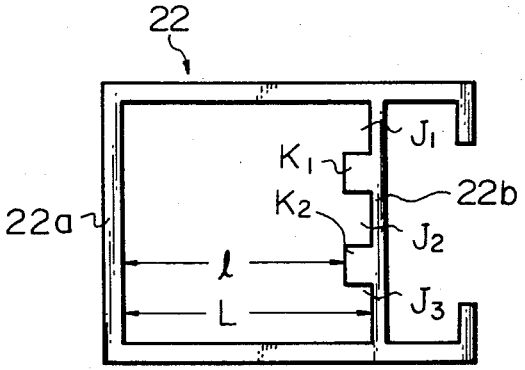
FIG. 6 is an end view of a frame member of a door used in another embodiment of the invention.
Figure 7:
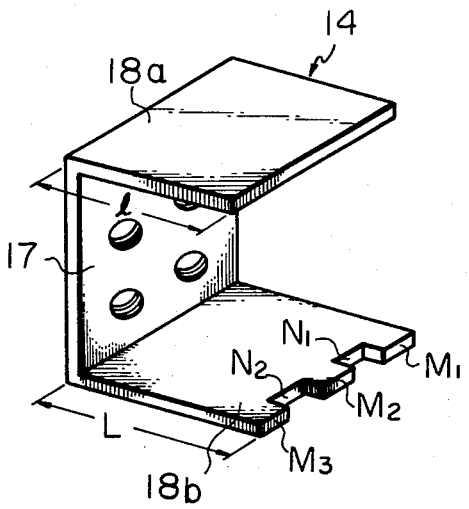
FIG. 7 is a perspective view of a backing member to be inserted in the frame member shown in FIG. 6.

Upon assembly, the lower backing member 4b and the upper backing member 4a are inserted in the frame member 2 in this order from one end thereof as shown in FIG. 5. The void portions 9b formed in the leg portions 8b of the lower backing member 4b are positioned in the place corresponding to the pawl 6a for the upper backing member 4a. Therefore, the lower backing member 4b is not stopped by the pawl 6a but passes this pawl and is stopped at the place intended therefor by engagement between the pawl 6b and the leg portion 8b. After this, the upper backing member 4a is stopped by engagement between the leg portion 8a and the pawl 6a. At this stage, the backing members 4a and 4b have been placed in their desired positions in the frame member 2. After that, the hinges 3a and 3b are placed on the forward end plate 2a and then the hinges 3a and 3b, the forward end plate 2a and the backing members 4a and 4b are fixed together by screws 5.

Another embodiment in which three backing members are to be mounted will be described referring to FIGS. 6 to 10. The rear end plate 22b of a frame member 22 has ledges on its inner surface to form grooves J1, J2 and J3 and rails K1 and K2. The distance between the inner surface of the forward end plate 22a and the bottom surface of each of the grooves J1, J2 and J3 is "L" whereas the distance between the inner surface of the forward end plate 22a and the top surface of each of the rails K1 and K2 is "1". A backing member 14 comprises a backing plate portion 17 having female screw thread holes and upper and lower leg portions 18a and 18b bent from the opposite ends of the backing plate portion 17 so that they extend normally to the backing plate portion, thereby having a shape of a rectangle open at one side. The upper and lower leg portions 18a and 18b are guided by the rear end plate 22b thereby functioning to keep the backing plate portion 17 adjacent and parallel to the forward end plate 22a. The width of the upper leg portion 18 is about "1" so that it is guided by the rails K1 and K2 formed on the rear end plate 22b. The lower leg portion 18b is recessed at its free end so as to form protrusions M1, M2 and M3 and notches N1 and N2. The distance between the outer surface of the backing plate portion 17 and the ends of the protrusions M1, M2 and M3 of the lower leg portion 18b is about "L" and the distance between the outer surface of the backing plate portion and the bottoms of the notches N1 and N2 is about "1". In other words, the protrusions M1, M2 and M3 of the lower leg portion 18b mate with the grooves J1, J2 and J3 of the rear end plate 22b, respectively. Pawls 16a, 16b and 16c are provided in respective grooves J1, J2 and J3 at the lower (FIG. 8), middle (FIG. 9) and upper (FIG. 10) positions so that they extend into the hollow portion of the frame member 22 and are opposed to the holes formed in the forward end plate 22a for passing screws at the lower, middle and upper mounting positions for hinges 3. The pawl 16b is disposed in the center of the hollow member or frame member 22 and the pawls 16a and 16c are placed in the upper and lower positions of the hollow member, respectively (as seen in FIGS. 8 and 10).

Upon assembly, the protrusions M2 and M3 of the lower leg portion 18b of a backing member 14 are first cut out and the backing member is inserted in the frame member 22 from one end thereof. Since the protrusions M2 and M3 associated with the upper and middle pawls 16c and 16b are removed, the backing member 14 is not stopped by these pawls but is stopped in the desired position by engagement between the lower pawl 16a and the protrusion M1. Similarly, the protrusions M1 and M3 of another backing member 14 is cut out leaving the protrusion M2 which is to be engaged by the middle pawl 16b and then the backing member is inserted in the frame member 22. Finally, another backing member 14 from which protrusions M1 and M2 are cut out leaving the protrusion M3 is inserted in the frame member 22. At this stage, the backing members 14 have been stopped and placed in their respective desired positions in the frame member 22. After that the hinges 3 are placed on the forward end plate 22a and then, the hinges 3, the forward end plate 22a and the backing members 14 are fixed together by screws.

It will be appreciated that by providing protrusions and notches of backing members 14 in accordance with the number of grooves and rails in the rear end plate 22b of a frame member 22 and placing pawls offset from each other, it will be possible to position an optional number of backing members 14 in the frame member 22.

Although this invention has been explained with reference to the embodiment used in a door, the invention is not limited to such use. The invention may be used in other application, such as connection between handrails and posts therefor. Furthermore, hollow members are not limited to angular tubular ones. Various kinds of hollow members such as cylindrical ones may be accepted for connecting other pieces thereto by adapting the shape of backing members.

What is claimed is:

1. A combination of a hollow member and a backing member to be inserted in the hollow member characterized in that the hollow member is provided with an inwardly extending pawl and the backing member is adapted to be placed in a desired position in the hollow member by engagement with the pawl, said hollow member has a mounting plate provided with holes for passing screws at the place where another member is to be secured and said backing member comprises a backing plate portion having threaded holes and a leg portion extending from the backing plate portion substantially normally thereto and functioning to keep said backing plate portion in the hollow member adjacent and parallel to said mounting plate, said pawl being adapted to engage with said leg portion.

2. A combination of a hollow member and a plurality of backing members to be inserted in the hollow member characterized in that the hollow member is provided with a plurality of inwardly extending pawls laterally offset from each other with respect to the longitudinal direction of the hollow member and the backing members are adapted to be placed in their respective desired positions in the hollow member by engagement with the pawls, said combination being further characterized in that each of the backing members, at least those except for the one to be placed closest to the end of the hollow member through which the backing members are inserted in the hollow member, has a void portion so that it does not interfere with the pawls above the intended pawl as it is inserted in the hollow member through said end.

3. A combination according to claim 2 further characterized in that said hollow member has a mounting plate provided with holes for passing screws at the places where other members are to be secured and each of said backing members comprises a backing plate portion having threaded holes and a leg portion extending from the backing plate portion substantially normally thereto and functioning to keep said backing plate portion in the hollow member adjacent and parallel to said mounting plate, said pawls being adapted to engage with said leg portions of the associated backing members, respectively.

* * * * *